US009142161B2

(12) United States Patent
Goden

(10) Patent No.: US 9,142,161 B2
(45) Date of Patent: Sep. 22, 2015

(54) DISPLAY APPARATUS AND A METHOD FOR DRIVING THE SAME

(75) Inventor: Tatsuhito Goden, Machida (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 129 days.

(21) Appl. No.: 13/523,118

(22) Filed: Jun. 14, 2012

(65) Prior Publication Data

US 2012/0320005 A1 Dec. 20, 2012

(30) Foreign Application Priority Data

Jun. 20, 2011 (JP) ..... 2011-136533

(51) Int. Cl.
*G09G 3/32* (2006.01)
*G09G 3/20* (2006.01)

(52) U.S. Cl.
CPC ..... *G09G 3/3225* (2013.01); *G09G 3/2022* (2013.01); *G09G 3/2029* (2013.01)

(58) Field of Classification Search
CPC ..... G09G 3/2025–3/204; G09G 3/3266; G09G 3/3275; G09G 3/2022; G09G 3/2029; G09G 3/3255
USPC ..... 345/204, 84, 55, 30, 690, 77, 213
See application file for complete search history.

(56) References Cited

U.S. PATENT DOCUMENTS 7,091,938 B2 * 8/2006 Inukai et al. ..... 345/76
7,113,154 B1 9/2006 Inukai
7,129,918 B2 * 10/2006 Kimura ..... 345/82
7,538,749 B2 * 5/2009 Chung et al. ..... 345/77
8,125,473 B2 * 2/2012 Chung et al. ..... 345/207
8,330,683 B2 * 12/2012 Chung et al. ..... 345/82
2005/0212729 A1 9/2005 Chung
2010/0188393 A1 * 7/2010 Seki ..... 345/213

FOREIGN PATENT DOCUMENTS

CN 1437178 A 8/2003
CN 1448902 A 10/2003
CN 101609839 A 12/2009
TW 522360 B 3/2003

* cited by examiner

*Primary Examiner* — Quan-Zhen Wang
*Assistant Examiner* — Xuemei Zheng
(74) *Attorney, Agent, or Firm* — Canon USA, Inc. IP Division

(57) ABSTRACT

In a display apparatus, selection signals are supplied sequentially to scanning lines in each subframe period including a frame period for performing a display scan to write display data to a plurality of data lines into pixel circuits in a first interval of a selection period. Selection signals are also supplied sequentially to scanning lines in at least two successive subframe periods including a frame period for performing an erase scan to write erase data to the plurality of data lines into pixel circuits in a second interval of the selection period. There is an overlapping period between two erase scan periods in the at least two successive subframe periods. During the overlapping periods, selection signals for performing the display scan and erase scan are supplied simultaneously to the scanning lines.

15 Claims, 7 Drawing Sheets

DISPLAY APPARATUS AND A METHOD FOR DRIVING THE SAME

BACKGROUND OF THE INVENTION

1. Field of the Invention

One disclosed aspect of the embodiments relates to a display apparatus, and more particularly, to a display apparatus using an organic electroluminescence (EL) display element.

2. Description of the Related Art

To represent a gradation in an image displayed on an active matrix organic electroluminescent display apparatus, it is known to divide one frame period into a plurality of subframe periods, and rewrite data on a subframe-by-subframe basis while scanning each frame. U.S. Pat. No. 7,113,154 discloses a subframe-controlled gradation representation technique in which a display scan for writing data and an erase scan for erasing are performed such that periods thereof are overlapped to achieve a light emission period with a length shorter than the length of one scan period. U.S. Pat. No. 7,129,918 discloses a technique in which when two or more scan periods overlap each other, a scan selection period of one line is divided into as many intervals as there are overlapping scans. Data is generated in each interval, and a selection pulse for selecting one scanning line is applied in each interval. More specifically, in a case where two display scans overlap each other, a scan selection period of each line is divided into two intervals. In each interval, data is applied to data lines and a selection signal is applied to a scanning line. In a case where a display scan and an erase scan overlap each other, display data is applied in one interval, and erase data is applied in the other interval.

In the technique in which scan periods overlap, each scan selection period is divided into a plurality of intervals and one scanning line is selected in each interval, the number of intervals increases with the number of overlapping scans, and a corresponding increase occurs in the scan selection period length. As a result, a corresponding increase occurs in the length of a period from a start to an end of scanning.

The length of one frame period is determined by a frequency at which one frame of image data is input to the display apparatus. Therefore, the increase in the length of the period necessary for the display scan results in a decrease in the number of subframes in one frame, which results in a decrease of the number of gradation levels that may be displayed.

SUMMARY OF THE INVENTION

According to an aspect of the embodiments, a display apparatus includes pixels circuits connected to light emitting elements, each of the pixel circuits being driven by one of a plurality of scanning lines and one of a plurality of data lines, a scanning line driving circuit configured to supply selection signals to the plurality of scanning lines, a data line driving circuit configured to supply display data and erase data to the data lines. The scanning line driving circuit and the data line driving circuit are operated so that a frame period is divided into a plurality of subframe periods, and in the subframe period, during the data line driving circuit supplies the display data to the plurality of data lines. The scanning line driving circuit supplies selection signals sequentially to the plurality of scanning lines to perform a plurality of display scans for writing the display data into the pixel circuits in a first interval of a selection period. During the data line driving circuit supplies the erase data to the plurality of data lines, the scanning line driving circuit supplies selection signals sequentially to the plurality of scanning lines to perform a plurality of erase scans for writing the erase data into the pixel circuits in a second interval of the selection period. The second interval immediately follows the first interval. At least one of the display scans is performed in each of the subframe periods in the frame period. The plurality of erase scans includes at least two erase scans each of which being performed in at least two successive subframe periods in the frame period, and the at least two erase scans have erase scan periods that partially overlap in an overlapping period. During the overlapping period selection signals are supplied simultaneously to the scanning lines selected for performing the erase scan in each of the at least two successive subframe periods.

According to another aspect of the embodiments, a method for driving a display apparatus is provided. The display apparatus comprises a plurality of scanning lines, a plurality of data lines crossing the scanning lines, pixel circuits each connected to one of the scanning lines and one of the data lines, and light emitting elements each connected to one of the pixel circuits.

The method includes operations for:

A. supplying display data to the plurality of data lines;

B. supplying selection signals sequentially to the plurality of scanning lines to perform a display scan for writing the display data into the pixel circuits in a first interval of a selection period, C. repeating operations A and B in each of subframe periods into which a frame period is divided;

D. supplying erase data to the plurality of data lines;

E. supplying selection signals sequentially to the plurality of scanning lines to perform an erase scan for writing the erase data into the pixel circuits in a second interval of the selection period, the second interval immediately following the first interval; and F. repeating operations D and E in at least two subframe periods in a frame period, wherein the operation E is at least performed twice in which each of the at least two erase scans have erase scan periods in at least two successive subframe periods in the frame period and the at least two erase scans have erase scan periods that partially overlap in an overlapping period, and during the overlapping period the selection signals in the operation E are supplied simultaneously to the scanning lines selected for performing the erase scan in each of the at least two successive subframe periods.

According to the embodiments, the overlap between erase scans does not result in an increase in scan period length and thus the overlap between erase scans does not cause a reduction in the number of subframes in one frame period. Therefore it is possible to maintain high image quality in terms of gradation.

Further features of the disclosure will become apparent from the following description of exemplary embodiments with reference to the attached drawings.

One disclosed feature of the embodiments may be described as a process which is usually depicted as a flowchart, a flow diagram, a timing diagram, a structure diagram, or a block diagram. Although a timing diagram or timing chart may describe the operations or events as a sequential process, the operations may be performed, or the events may occur, in parallel or concurrently. An operation in a flowchart or a timing diagram or timing chart may be optional. In addition, the order of the operations or events may be rearranged.

DESCRIPTION OF THE EMBODIMENTS

The present disclosure may be applied to, for example, a matrix display apparatus including pixels disposed at intersections between scanning lines and data lines. In the matrix display apparatus, data given via data lines is written into pixels while selecting scanning lines sequentially in a predetermined order. Each time all scanning lines are selected, one image is displayed. This is referred to as scanning.

Figure 1:
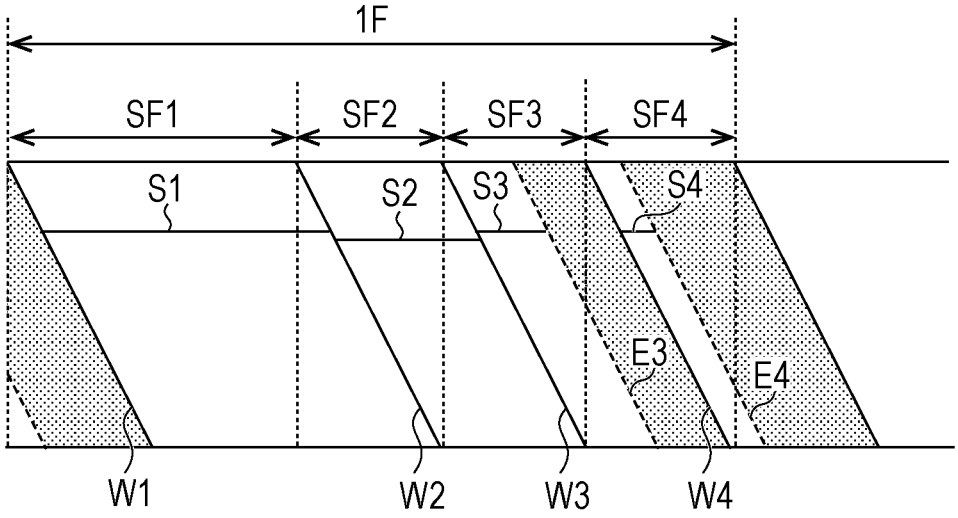
FIG. 1 is a diagram illustrating a manner in which scanning is performed in each subframe according a first embodiment.

FIG. 1 illustrates a sequential scanning process for case where 16 gradation levels are displayed for a 4-bit digital image signal. A horizontal axis represents time, and a vertical axis represents a scanning line location (address). Oblique lines represent a manner in which scanning lines are selected sequentially with time from a top scanning line to a bottom scanning line.

One frame period 1F is divided into four subframes SF1 to SF4. In respective subframe periods, display scans W1 to W4 are performed as represented by solid lines in FIG. 1. In each display scan, display data corresponding to image data to be displayed is supplied to data lines and written into pixels.

One subframe period is a period from a start of one display scan to a start of next display scan. The respective subframe periods have a length of SF1=2, SF2=1, SF3=1, and SF4=1 in units of display scan periods. In the respective subframe periods, display scans W1 to W4 are performed to write digital image data. Light emission periods in the respective subframes SF1 to SF4 are S1=2, S2=1, S3=½, and S4=¼ in units of display scan periods. In the subframes SF3 and SF4, the light emission periods are shorter than the corresponding subframe periods, and thus erase scans E3 and E4 are performed as represented by broken lines in FIG. 1.

In any subframe, a display scan starts after an end of a previous display scan, and thus there is no overlap in time between display scans. However, the display scan W4 and also the erase scan E4 in the subframe SF4 start before the end of the erase scan E3 in the subframe SF3, and thus the erase scans E3 and E4 overlap each other in parts of their periods.

In the display scan and the erase scan, a period from the start to the end thereof is referred to as a scan period. When there is an overlap between two scan periods, it is said that there is an overlap between the two corresponding scans. In a subframe in which a light emission period is shorter than a subframe period, an overlap occurs between a display scan and an erase scan following the display scan. In the example shown in FIG. 1, overlaps occur among three scans, i.e., the erase scans E3 and E4 and the display scan W4 performed between the erase scans E3 and E4.

In one embodiment, when erase scans overlap each other, erase data is supplied to data lines during an overlapping period, and scanning lines scanned in the two overlapping erase scans are selected simultaneously whereby the same one piece of erase data is written simultaneously. Thus, in this technique, the number of data supplied to the data line during one selection period is two, i.e., only one display data and one erase data are supplied during one selection period, and it is not necessary to increase the number of intervals for the data line even when there is an overlap between erase scans. Therefore, the overlap between erase scans does not cause an increase in the length of the period from the start to the end of the scan, and thus a reduction in the number of gradation levels may be prevented.

In the example shown in FIG. 1, it is assumed by way of example that 16 gradation levels are displayed by 4-bit data. Note that the number of bits and the number of subframes are not limited to those in this example. Furthermore, an erase scan may be performed also in the subframe SF1 and/or subframe SF2. In this case, the erase scan is located immediately before the display scan in the next subframe.

The disclosure is described in further detail below with reference to specific embodiments.

First Embodiment

Figure 2:
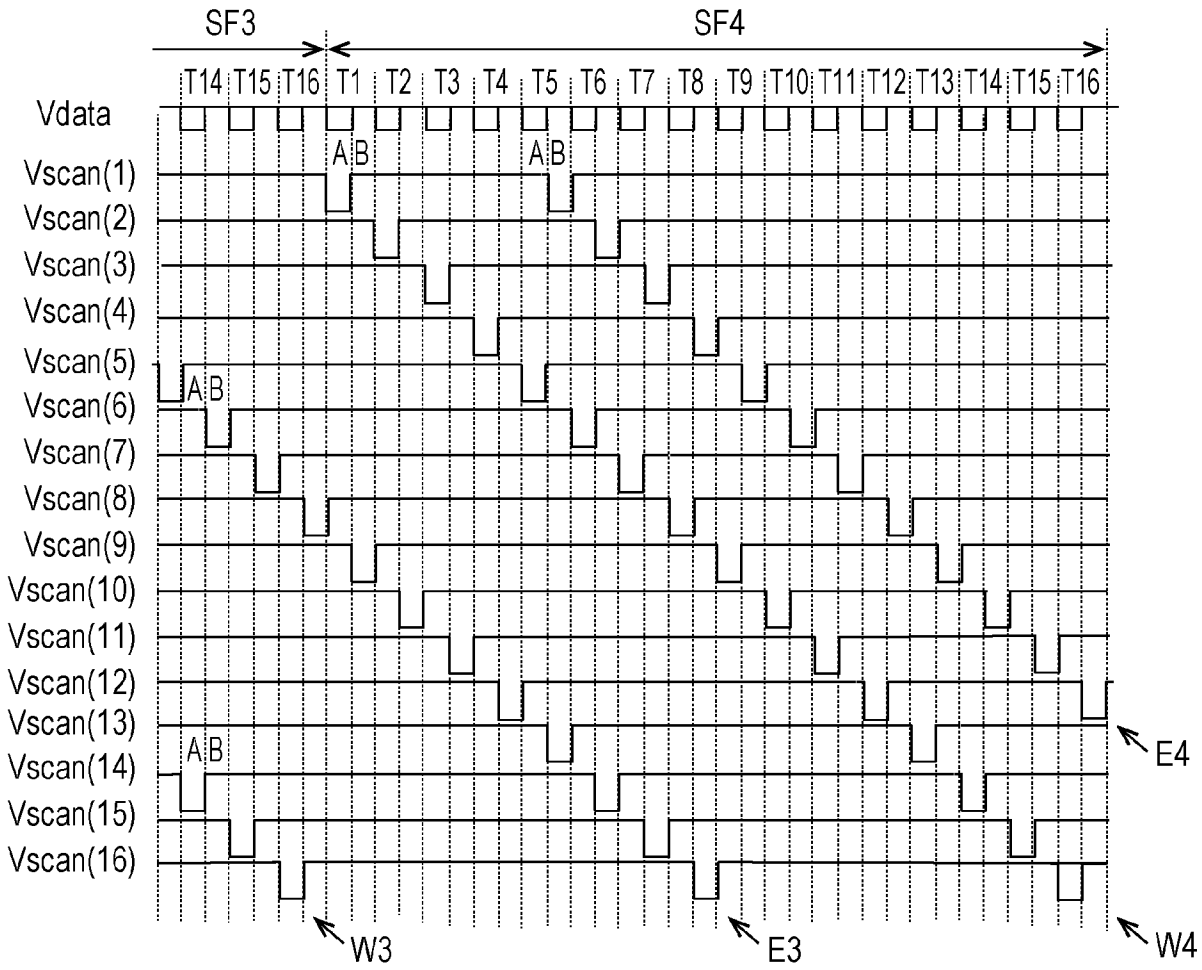
FIG. 2 is a timing chart associated with a data signal and a scanning signal according to the first embodiment.

FIG. 2 is a timing chart illustrating a manner of driving a display apparatus according to a first embodiment. In this figure, the subframes SF3 and SF4 shown in FIG. 1 are partially extracted, and signals provided via a data line and scanning lines in the extracted parts of the subframes SF3 and SF4 are shown. Note that it is assumed, for simplicity, that there are only 16 scanning lines.

A data signal Vdata is supplied to the data line. In synchronization with the data signal Vdata, scan signals Vscan(1) to Vscan(16) are supplied to the 16 scanning lines thereby sequentially selecting these scanning lines.

One subframe period is divided into selection periods T1 to T16 corresponding to the respective 16 scanning lines.

Each of the periods T1 to T16 is divided into two intervals A and B. Display data is supplied to the data line such that display data with a high (H) level or a low (L) level is supplied in the interval A and erase data (black-level data) with the H level is supplied in the interval B following in time the interval A.

One scan starts from a scanning line on the top in one of the selection periods T1 to T16, and scanning lines are scanned sequentially in the 16 selection periods T1 to T16. The scan ends when a bottom scanning line is reached and scanned. Although not shown in FIG. 2, a selection signal of the display scan W3 in the subframe SF3 starts from the selection period T1 in the subframe SF3 and ends at the selection period T16. In the subframe SF4 immediately following the subframe SF3, the display scan W4 starts from the selection period T1 and ends at the selection period T16.

The display scan in each subframe is performed in synchronization with the interval A that is a first interval of the two intervals A and B. That is, in the interval A, the scan signal Vscan in the display scan has the selection level (L level) to select the corresponding line, and the display data supplied via the data line is written into the pixel circuit.

After a delay since the start of the display scan W3, the erase scan E3 starts. Although not shown in FIG. 2, the erase scan E3 in the subframe SF3 starts from the period T9 in the subframe SF3 after a delay of selection periods corresponding to 8 lines since the display scan W3, and ends in the period T8 in the next subframe SF4.

The time interval between the display scan and the erase scan is set so as to correspond to the light emission period. The light emission period in the subframe SF4 is equal to one-half the light emission period in the subframe SF3, and thus the erase scan E4 in the subframe SF4 starts in the selection period T5 after a delay of selection periods corresponding to 4 lines since the display scan W4.

In the subframe SF3, the display scan W3 and the erase scan E3 overlap each other in periods from T9 to T16. In the subframe SF4, the display scan W4 and the erase scan E4 overlap each other in periods from T5 to T16. As described above, the erase scan overlaps the display scan in some particular periods of the same frame, and during these overlapping periods, the display data and the erase data are alternately supplied to the data line in the intervals A and the intervals B, and concurrently therewith selection signals for the display scan and the erase scan are supplied to the scanning lines.

In the subframe SF4, the erase scan E3 and the erase scan E4 overlap each other in the selection periods from T5 to T8. In any erase scan, the selection signal is applied to the scanning lines in synchronization with the intervals B. Thus, in any overlapping period, the selection signal (L level) is applied to two scanning lines simultaneously and the same erase data is written in pixel circuits.

When erase scans overlap, scanning lines are selected simultaneously, and erasing is performed using the same single erase data. When three erase scans overlap, three scanning lines are selected simultaneously, and erasing is performed using the same single erase data. It is sufficient to supply the erase data only in one interval and it is not necessary to provide two or more erase data intervals.

In the present embodiment, there is no overlap between display scans, it is sufficient to provide only one display data interval A in each selection period. That is, each of the selection periods T1 to T16 is divided into two intervals A and B, and one of these two intervals A and B is employed as a display data interval and the other as an erase data interval.

Figure 3:
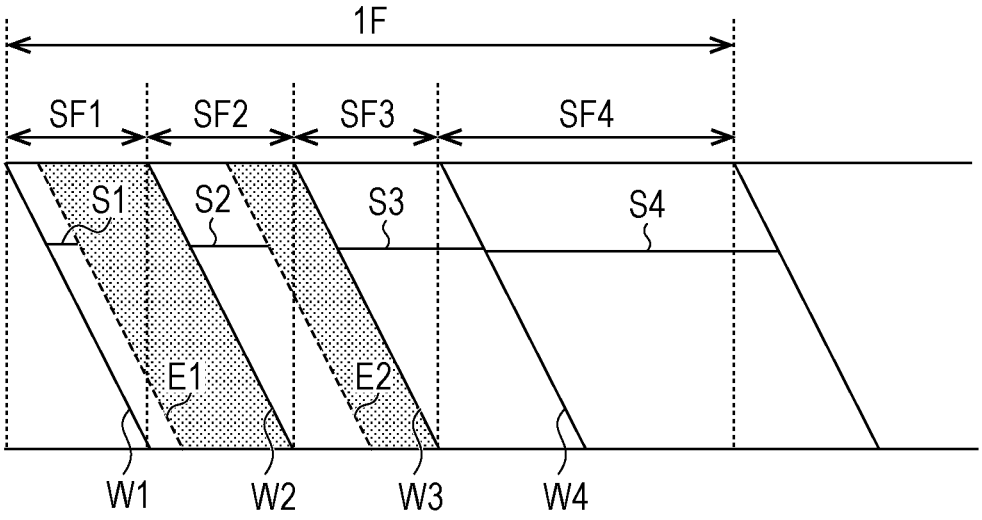
FIG. 3 is a diagram illustrating a manner in which scanning is performed in an order different from that shown in FIG. 1.

FIG. 3 illustrates another example in which subframes are arranged in an opposite order to the order shown in FIG. 1. In this example, the light emission periods in the respective subframes are S1=¼, S2=½, S3=1, and S4=2 in units of display scan periods. Because the subframes are arranged in the order of the light emission period from the shortest to the longest, the erase scans E1 and E2 do not overlap.

As described above, there is a possibility that an overlap between erase scans may be eliminated by rearranging the order of light emission periods. However, there is an inevitable overlap between a display scan and an erase scan, each period assigned to one line needs to include two intervals A and B. Note that two intervals A and B are sufficient and no more intervals are necessary unless there is an overlap between display scans. No overlap occurs between display scans no matter how the light emission order is changed from that shown in FIG. 1 or FIG. 3, the scanning method using two intervals for respectively dealing with display data and erase data in each selection period according to the present embodiment may be used regardless of the order of subframes. The order of subframes may be arbitrarily switched by controlling a scanning line driving circuit (described later) in terms of scan start timing to change the order of applying a digital image signal to a data line driving circuit. The capability of changing the order of subframes is useful to reduce blur in a moving image and reduce a false contour that may appear in the subframe-controlled gradation representation.

Comparative Example

Figure 4:
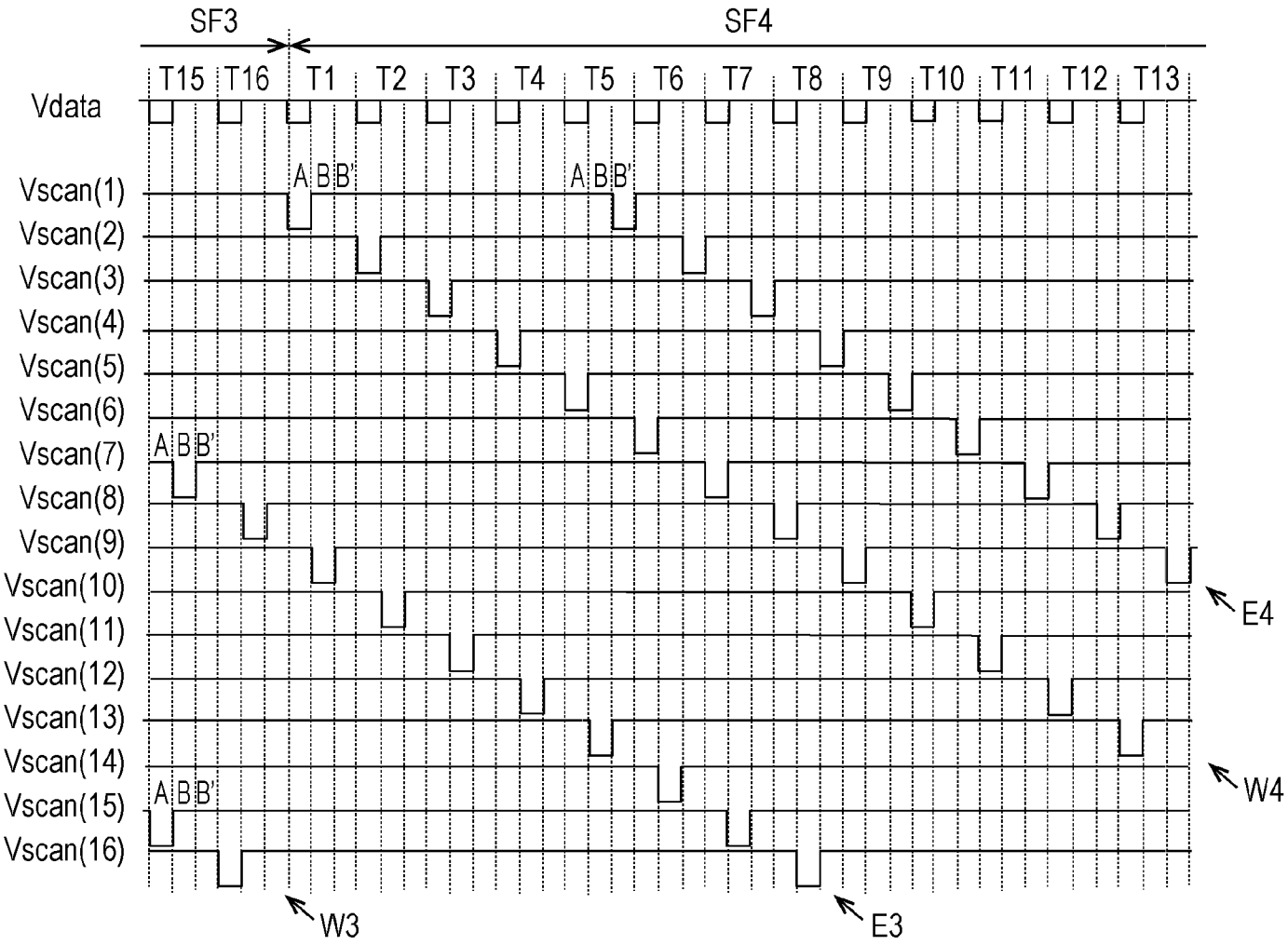
FIG. 4 is a timing chart associated with a data signal and a scanning signal according to a comparative example.

FIG. 4 illustrates a comparative example in which when there is an overlap between erase scans in the driving method shown in FIG. 1, erase data is supplied to the data line over two intervals and scanning lines scanned in the overlapping erase scans are separately selected and applied with selection signals.

Each subframe is divided into 16 selection periods T1 to T16 as in the first embodiment. However, unlike the first embodiment, each selection period is divided into three intervals A, B, and B'. In the interval A, display data with the H level or the L level is supplied to the data line and erase data (black-level data) is supplied in the intervals B and B'.

There is no overlap between the display scans W3 and W4, and thus in the interval A in the display scans W3 and W4, a scan signal serving as a selection signal (L level) is applied to the scanning lines. The erase scans E3 and E4 overlap each other in selection periods from T5 to T8 in the subframe SF4 in which the scanning lines scanned by the erase scan E3 are applied with selection signals in synchronization with the respective intervals B and the scanning lines scanned by the erase scan E4 are applied with selection signals in synchronization with the respective intervals B' such that only one scanning line is applied with a selection signal in each interval.

In this method in which one scanning line is selected in one interval, the data line driving circuit needs to perform writing for only one pixel circuit in any state, and thus this method has a merit that there is no change in output load. However, the necessity of three data intervals results in an increase in time from the start to the end of each scan by a factor of 1.5 compared with that according to the first embodiment. When the one frame has a length of 1/60 seconds, the scan time according to the first embodiment is 1/300 seconds. If the scan time is increased by a factor of 1.5 to 1/200 seconds, only three subframes are allowed to be included in one frame, and thus the digital gradation is limited to that of 3 bits.

Second Embodiment

Figure 5:
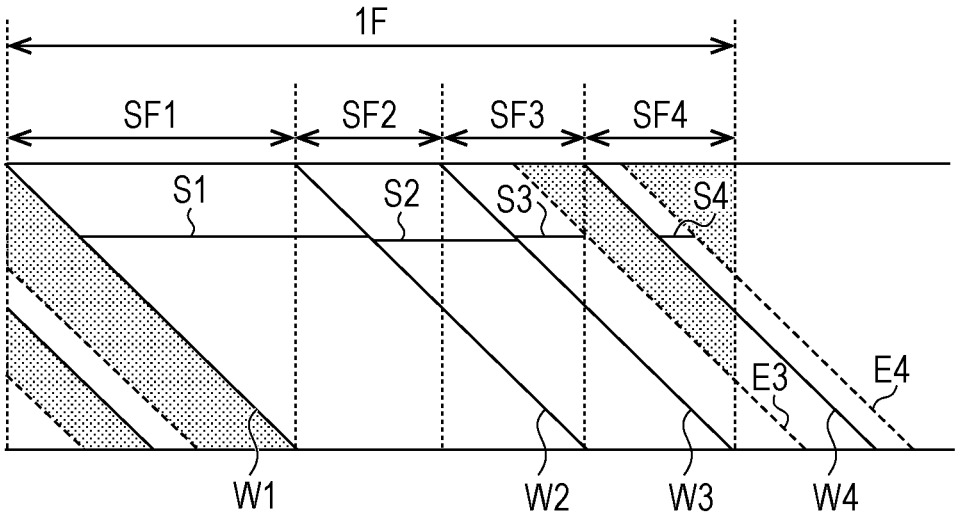
FIG. 5 is a diagram illustrating a manner in which scanning is performed in each subframe according a second embodiment.

FIG. 5 illustrates a driving method for a case where there is an overlap between display scans in some periods. In this embodiment, gradation with 16 levels is represented by 4 bits as in the first embodiment and the comparative example. In this embodiment, except for SF1 the length of each subframe period is set to be one-half the scan period length. In subframes SF1, SF3, and SF4, the display scan starts when one half of the display scan in the previous subframe is complete.

Overlaps occur between display scans W2 and W3 in the subframe SF3, between display scans W3 and W4 in the subframe SF4, and between a display scan W1 in the subframe SF1 and a display scan W4 in a previous frame. In the subframes SF1 and SF4, an overlap occurs between erase scans E3 and E4.

In the first embodiment described above, no overlap occurs between two display scans because any display scan starts after the end of a previous display scan period. However, in the present embodiment, in a subframe period shorter than the display scan period, an overlap occurs between display scans. Furthermore, when an erase scan is performed between two overlapping display scans, an overlap occurs between erase scans.

Figure 6:
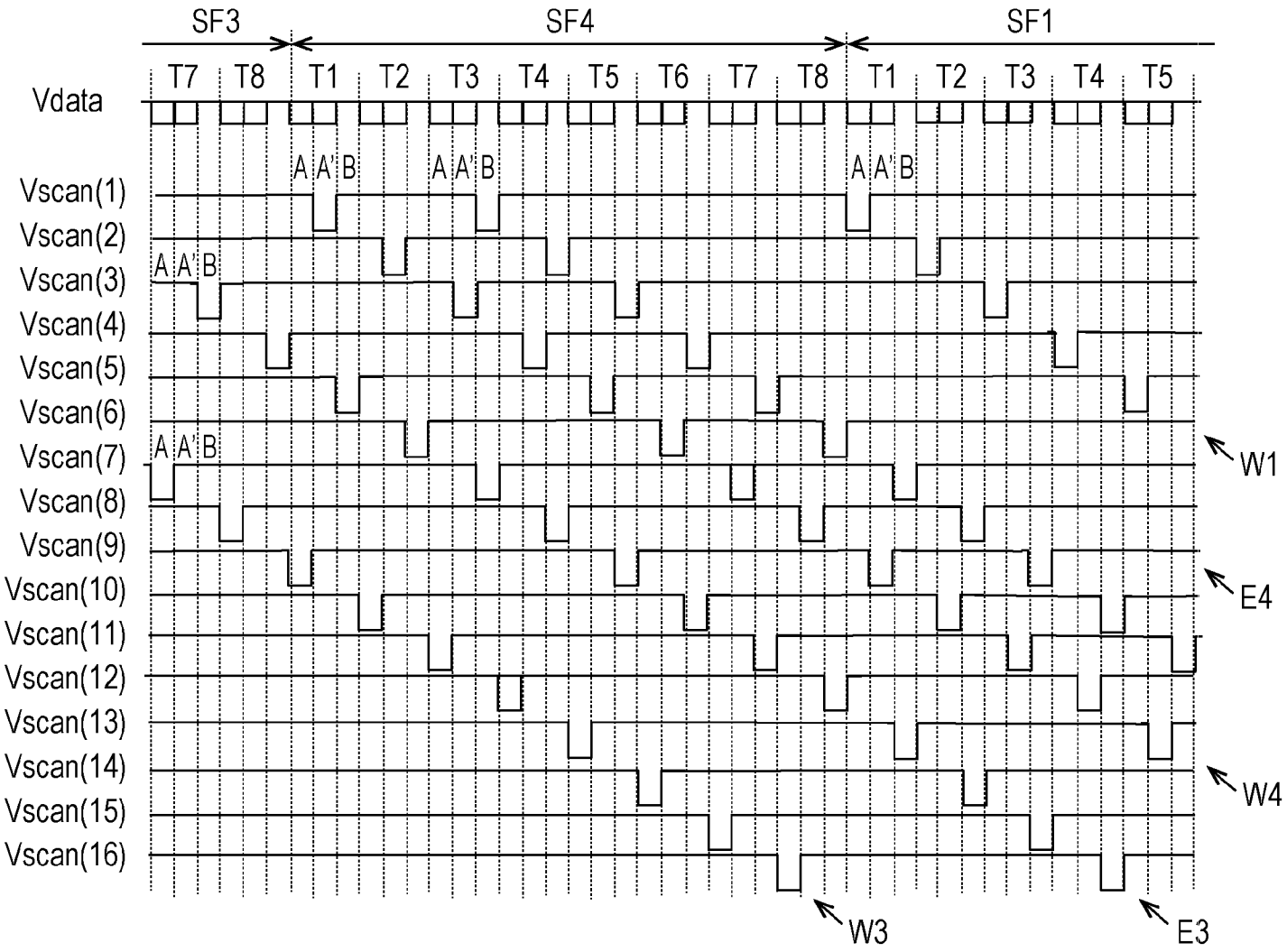
FIG. 6 is a timing chart associated with a data signal and a scanning signal according to the second embodiment.

FIG. 6 is a timing chart associated with signals applied to the data line and scanning lines according to the drive scan method shown in FIG. 5. Note that it is assumed, for simplicity, that there are only 16 scanning lines. The subframes SF3 and SF4 each have a length equal to 8 selection periods.

Because any overlap between display scans occurs between two display scans, it is necessary to provide two display data intervals in each selection period. On the other hand, the erase scans overlap each other for a time and do not overlap for another time. The number of erase scans at a time may be one, two or more. In any case, only one erase data interval is necessary. Thus, each selection period is divided into three intervals A, A', and B, wherein two intervals A and A' are display data intervals and the remaining one interval B is an erase data interval.

The display scan W3 in the subframe SF3 is performed in synchronization with display data in the display data intervals A. Although not shown in FIG. 6, the display scan W3 starts from the selection period T1 in the subframe SF3. In this subframe SF3, one half of the total lines, i.e., first to 8th lines are scanned. The remaining one half of the total lines, i.e., 9th to 16th lines are scanned in the selection periods from T1 to T8 in the following subframe SF4.

The display scan W4 in the subframe SF4 is synchronous with the display data intervals A'. The display scan W4 starts from selection period T1 in the subframe SF4 and continues until the selection period T8 in the subframe SF1 in the next frame although not shown in FIG. 6. Thus, the display scan W3 in the subframe SF3 and the display scan W4 in the subframe SF4 overlap each other in the selection periods T1 to T8 in the subframe SF4. However, the scanning lines in the display scan W3 turn to the selection signal level in the corresponding intervals A, while the scanning lines in the display scan W4 turn to the selection signal level in the corresponding intervals A', and thus writing is performed for different display data and no mixing of display data occurs.

On the other hand, erase scans are performed as follows. The erase scan E3 following the display scan W3 in the subframe SF3 is performed in synchronization with the intervals B in the selection periods T5 to T8 in the subframe SF3, the selection periods T1 to T8 in the subframe SF4, and the selection periods T1 to T4 in the subframe SF1 in the next frame. The erase scan E4 following the display scan W4 in the subframe SF4 is performed in synchronization with the intervals B in the selection periods from T3 in the subframe SF4 to T8 in the subframe SF1 in the next frame. Thus, the erase scan E3 and the erase scan E4 overlap each other in the selection periods from T3 in the subframe SF4 to T4 in the subframe SF1 in the next frame. In the two erase scans, scanning lines are simultaneously selected in synchronization with the intervals B and erasing is performed simultaneously.

When there is an overlap between display scans, it is necessary to provide as many display data intervals as the number of overlapping display scans. In contrast, however, only one erase data interval is necessary regardless of the number of erase scans, because the erase scans may be performed simultaneously using the same erase data. Thus, any overlap between erase scans does not result in an increase in scan period length, and thus the overlap does not result in a reduction in the number of gradation levels.

Display Apparatus

Figure 7A:
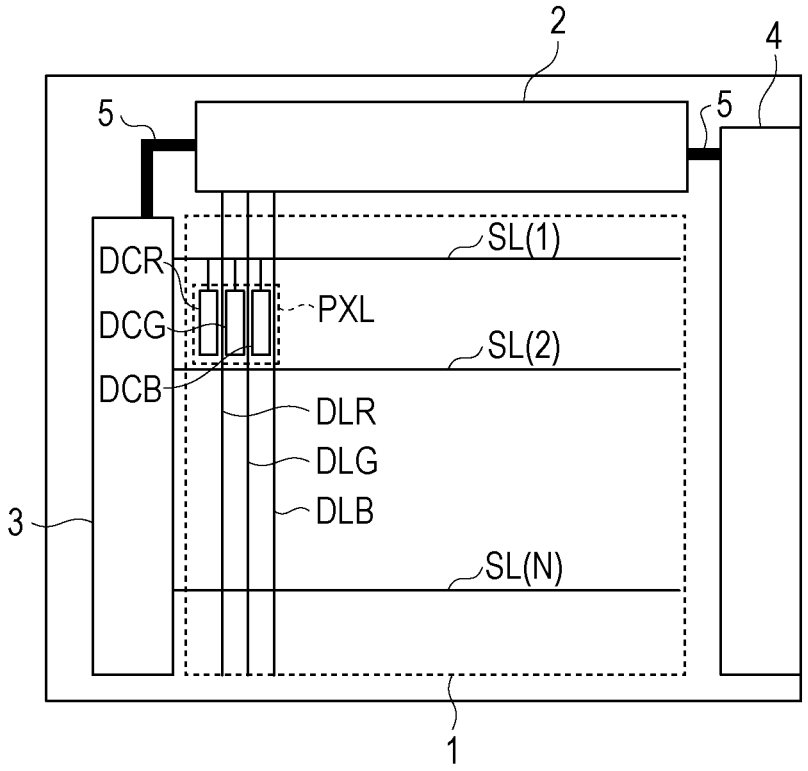
FIG. 7A is a diagram illustrating an overall structure of a display apparatus according to an embodiment.
Figure 7B:
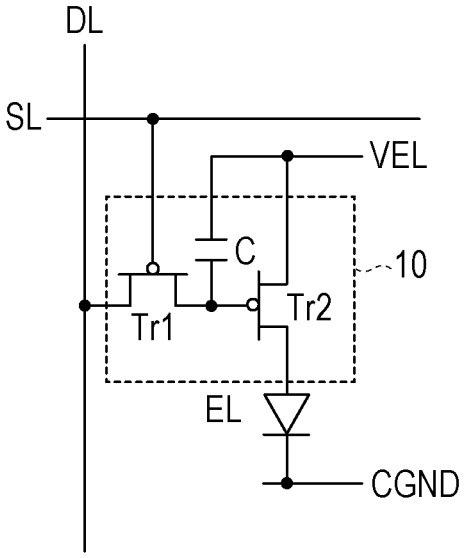
FIG. 7B is a diagram illustrating one of pixels thereof.

FIG. 7A is a schematic diagram illustrating a display apparatus according to the first or second embodiment, and FIG. 7B is a diagram illustrating one of pixels including a light emitting element and a pixel circuit.

The display apparatus shown in FIG. 7A includes a matrix display unit 1 in which display units PXL are arranged in a matrix having N rows and M columns wherein each display unit PXL includes three pixels DCR, DCG and DCB configured to emit three colors, i.e., red (R), green (G), and blue (B), respectively. Each pixel DC (DCR, DCG, or DCB) includes an organic electroluminescent element EL capable of taking two states, i.e., a light emission state and a no light emission state, and a pixel circuit 10 configured to drive the organic electroluminescent element EL.

Pixels are located at intersections between the N scanning lines SL(1), SL(2), . . . , SL(N) and the 3M data lines DLR, DLG, and DLB, and each pixel is connected to corresponding one of the scanning lines SL and the data lines DC. In the following description, when an explanation is concerned with a general scanning lines not depending on particular locations, a suffix (i) indicating the line number is omitted. Furthermore, when an explanation is concerned with general pixels not depending on particular colors, suffixes R, G, and B indicating colors are also omitted.

As shown in FIG. 7B, each pixel circuit 1 includes two transistors Tr1 and Tr2 and a capacitor C. The gate of the transistor Tr1 is connected to a corresponding one of the scanning lines SL. The transistor Tr1 turns on or off according to a voltage applied to the gate of the transistor Tr1 via the scanning line thereby making or cutting off an electric connection between the data line DL connected to the drain and the one end of the capacitor connected to the source of the transistor Tr1. More specifically, when a selection signal with a low (L) level is applied via the scanning line SL, the transistor TR1 turns on, and thus the voltage Vdata on the data line DL is applied to the capacitor C. When the scanning line turns into a high (H) level, the transistor Tr1 turns off. Note that the voltage applied from the data line DL is stored by the capacitor C. The gate of the transistor Tr2 is connected one end of the capacitor C and the source of the transistor Tr1. The source of the transistor Tr2 is connected to a power supply voltage VEL, and the drain of the transistor Tr2 is connected to the anode of the organic electroluminescent element EL. The cathode of the organic electroluminescent element EL is grounded. The gate-source voltage of the transistor Tr2 is given by the voltage across the capacitor C, and a current depending on the gate-source voltage is provided from the transistor Tr2 to the organic electroluminescent element EL.

Referring again to FIG. 7A, a scanning line driving circuit 3 for supplying scan signals to scanning lines, a data line driving circuit 2 for supplying data signals to data lines, and a connection terminal 4 for an external electric connection are disposed in areas outside and close to the matrix display unit 1. A control signal that controls the scan start timing is input to the connection terminal 4 and transferred to the scanning line driving circuit 3 via a wiring 5. A digital image signal is supplied on a subframe-by-subframe basis to the data line driving circuit 2. It is possible to switch the order of subframes by changing the order of the digital image signal and controlling the timing of starting the display scans and the erase scans.

Subframe-Controlled Gradation Representation

In the subframe-controlled gradation representation, input image data in each frame is converted into a digital signal image with a particular number of bits (4 bits in the first and second embodiments) and applied to the display apparatus. Each bit of the digital signal image is displayed on a display unit 1 in particular one of the subframe periods. The original image is reproduced by the time average of images in the subframes taken over one whole frame period. Note that one frame period is a period in which one image is displayed.

In each subframe, the digital signal image is displayed in the form of a binary image. The luminance of each pixel is given by the sum of light emission periods of the pixel taken over one whole frame. The original image is reproduced by the time average of the digital signal images in subframes taken over one whole frame.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2011-136533 filed Jun. 20, 2011, which is hereby incorporated by reference herein in its entirety.

What is claimed is:

1. A display apparatus comprising:

pixel circuits connected to light emitting elements, each of the pixel circuits being driven by one of a plurality of scanning lines and one of a plurality of data lines;

a scanning line driving circuit configured to supply selection signals to the plurality of scanning lines to provide a selection period dividing into at least three consecutive intervals including first, second, and third intervals having equal lengths;

a data line driving circuit configured to supply display data and erase data to the data lines, wherein the scanning line driving circuit and the data line driving circuit are operated so that a frame period is divided into a plurality of subframe periods, and in the subframe period, during the data line driving circuit supplying the display data to the plurality of data lines, the scanning line driving circuit supplies selection signals sequentially to the plurality of scanning lines to perform a plurality of display scans for writing the display data into the pixel circuits in the first and second intervals of the selection period, and during the data line driving circuit supplying the erase data to the plurality of data lines, the scanning line driving circuit supplies selection signals sequentially to the plurality of scanning lines to perform a plurality of erase scans for writing the erase data into the pixel circuits in the third interval of the selection period, wherein at least one of the plurality of display scans is performed in each of the subframe periods in the frame period, wherein the plurality of erase scans include at least one erase scan that starts in a first subframe period, goes through a second subframe period entirely, and ends in a third subframe period, and wherein during the overlapping period, selection signals are supplied simultaneously to the scanning lines selected for performing the erase scan in each of the at least two successive subframe periods.

2. The display apparatus according to claim 1, wherein there is no overlap between a period from a start to an end of a display scan and a period from a start to an end of any other display scan.

3. The display apparatus according to claim 1, wherein in the selection period, two of the display data and one of the erase data are alternately supplied to the data lines.

4. The display apparatus according to claim 1, wherein the scanning line driving circuit is applied with a control signal to rearrange the order of length of the subframe periods.

5. The display apparatus according to claim 1, wherein an interval between the display scan and the erase scan corresponds to the light emission period of the light emitting element in the subframe period.

6. The display apparatus according to claim 5, wherein a gradation is represented by the total light emission period in a frame period.

7. The display apparatus according to claim 1, wherein the plurality of display scans include at least two display scans each of which being performed in at least two successive subframe periods in the frame period and the at least two display scans have display scan periods that partially overlap.

8. The display apparatus according to claim 7, wherein the at least three intervals include at least two display intervals and one erase interval and data writing is performed in the at least two display intervals such that no mixing of display data occurs.

9. A method for driving a display apparatus which comprises a plurality of scanning lines, a plurality of data lines crossing the scanning lines, pixel circuits each connected to one of the scanning lines and one of the data lines, and light emitting elements each connected to one of the pixel circuits, the method comprising operations for:

A. supplying display data to the plurality of data lines;

B. supplying selection signals sequentially to the plurality of scanning lines to provide a selection period dividing into at least three consecutive intervals including first, second, and third intervals having equal lengths and to perform a display scan for writing the display data into the pixel circuits in the first and second intervals of the selection period, C. repeating operations A and B in each of subframe periods into which a frame period is divided;

D. supplying erase data to the plurality of data lines;

E. supplying selection signals sequentially to the plurality of scanning lines to perform an erase scan for writing the erase data into the pixel circuits in the third interval of the selection period; and F. repeating operations D and E in at least three consecutive subframe periods including first, second, and third subframe periods in a frame period, wherein the erase scan in operation E starts in the first subframe period, goes through the second subframe period entirely, and ends in the third subframe period.

10. The method according to claim 9, wherein there is no overlap between periods from a start to an end of the operation B.

11. The method according to claim 9, wherein in the selection period, two of the display data and one of the erase data are alternately supplied to the data lines.

12. The method according to claim 9, wherein an interval between the operation B and the operation E in the subframe period corresponds to the light emission period of the light emitting element.

13. The method according to claim 12, wherein a gradation is represented by the total light emission period in a frame period.

14. The method according to claim 9, wherein the operation B is at least performed twice in which each of at least two display scans is performed in at least two successive subframe periods in the frame period and the at least two display scans have display scan periods that partially overlap.

15. The method according to claim 14, wherein the at least three intervals include at least two display intervals and one erase interval and data writing is performed in the at least two display intervals such that no mixing of display data occurs.

* * * * *